US007878769B1

(12) United States Patent
Warnke et al.

(10) Patent No.: US 7,878,769 B1
(45) Date of Patent: Feb. 1, 2011

(54) AUTOMATIC TRANSMISSION PUMP-PRIMING DEVICE

(75) Inventors: Robert C. Warnke, Spooner, WI (US); Jesse C. Warnke, Brown Deer, WI (US)

(73) Assignee: Sonnax Industries, Inc., Bellows Falls, VT (US)

( * ) Notice: Subject to any disclaimer, the term of this patent is extended or adjusted under 35 U.S.C. 154(b) by 1407 days.

(21) Appl. No.: 11/341,157

(22) Filed: Jan. 27, 2006

Related U.S. Application Data

(60) Provisional application No. 60/647,373, filed on Jan. 27, 2005.

(51) Int. Cl.
*F04B 23/08* (2006.01)

(52) U.S. Cl. ..... 417/199.2; 417/307; 192/61

(58) Field of Classification Search ..... 417/199.2, 417/307, 435; 192/3.29, 3.3, 61; 475/116, 475/120, 127; 477/156, 157, 158
See application file for complete search history.

(56) References Cited

U.S. PATENT DOCUMENTS 3,230,791 A * 1/1966 Kelley et al. ..... 477/150
3,509,784 A * 5/1970 Mahoney ..... 477/127
3,747,439 A * 7/1973 Uozumi et al. ..... 477/150
3,968,707 A * 7/1976 Dach ..... 477/150
4,021,155 A * 5/1977 Erikson et al. ..... 417/302
6,712,726 B1 * 3/2004 Jackson et al. ..... 475/127

* cited by examiner

*Primary Examiner*—Devon C Kramer
*Assistant Examiner*—Patrick Hamo
(74) *Attorney, Agent, or Firm*—Downs Rachlin Martin PLLC; Clifford F. Rey

(57) ABSTRACT

A pump-priming device configured to fit within the pump inlet circuit formed in the valve body of an automatic transmission is disclosed. The present pump priming device comprises a fluid-conducting structure having a fluid inlet and a fluid outlet, which is fabricated from sheet metal or flexible tubing and is designed to be installed within the original equipment manufacture valve body as a drop-in-place component. The present pump priming device diverts the flow of automatic transmission fluid (i.e. regulator exhaust fluid) released by the pressure regulator valve, which under normal operating conditions would flow from the pressure regulator valve back to the sump, and to redirect such flow of regulator exhaust fluid back to the pump inlet. Such redirection of regulator exhaust fluid pressurizes the pump inlet circuit and raises the output of the pump to provide adequate transmission fluid flow within the hydraulic system at low engine speeds.

7 Claims, 9 Drawing Sheets

AUTOMATIC TRANSMISSION PUMP-PRIMING DEVICE

CROSS REFERENCE TO RELATED APPLICATION

This application claims the benefit under 35 U.S.C. 119(e) of U.S. Provisional Patent Application No. 60/647,373 filed Jan. 27, 2005 entitled Automatic Transmission Pump Priming Device.

BACKGROUND OF INVENTION

The present invention relates to automatic transmissions for land vehicles and, more particularly, to a pump-priming device for an automatic transmission fluid pump.

Fluid pumps in automatic transmission systems are generally positive displacement pumps driven by the engine of the vehicle wherein the transmission is installed. A positive displacement pump is one, which has the same output per revolution regardless of pump speed or hydraulic pressure already developed in the system. Thus, it is necessary to regulate automatic transmission fluid (hereinafter "ATF") pressure so it does not get too high and damage other components. A basic pressure regulator valve employs a piston and a spring that compresses at a specific pressure to allow some ATF to flow back to the pump reservoir or sump bypassing the hydraulic circuit and reducing system pressure. By using a pressure regulator valve with a spring calibrated to a pressure lower than the pump's output, a generally constant pressure can be maintained in the hydraulic system during operation. Of course, given the continuous flow requirements of the hydraulic system, a consistent flow of ATF from the sump to the pump is critical to the proper function and lubrication of the transmission.

CHRYSLER automatic transmissions such as the series 727, 904, and 42 to 47RE transmissions (hereinafter "CHRYSLER transmissions") utilized in rear wheel drive vehicles are known in the transmission repair industry to exhibit characteristic malfunctions, which are related to insufficient automatic transmission fluid (hereinafter "ATF") flow to the pump at low engine speeds. The resulting service complaints in CHRYSLER vehicles include engine stall on transmission engagement, slow torque converter charge at engine idle, buzzing sounds from hydraulic valves, and pump noise.

Thus, the present invention has been developed to resolve these problems and other shortcomings of the prior art.

SUMMARY OF THE INVENTION

Accordingly, the present invention is an ATF pump priming device, which is configured to fit within the pump inlet circuit formed in the valve body of the transmission. The present pump priming device comprises an auxiliary ATF channel structure or duct fabricated from sheet metal or other suitable material such as flexible tubing, which is designed for installation within the original equipment manufacture (hereinafter "OEM") valve body as a drop-in-place aftermarket component.

The present pump priming device functions to divert the flow of ATF (i.e. regulator exhaust fluid), which under normal operating conditions would flow from the pressure regulator valve back to the sump, and to redirect such flow of regulator exhaust fluid back to the pump inlet. This redirection of regulator exhaust fluid pressurizes the pump inlet circuit and raises the output of the pump to ensure adequate ATF flow to the hydraulic system at low engine speeds.

Thus, there has been outlined, rather broadly, the important features of the invention in order that the detailed description thereof that follows may be better understood, and in order that the present contribution to the art may be better appreciated. There are additional features of the invention that will be described hereinafter and which will form the subject matter of the claims appended hereto.

Those skilled in the art will appreciate that the conception upon which this disclosure is based may readily be utilized as a basis for the designing of other structures, methods, and systems for carrying out the purposes of the present invention. It is important, therefore, that the claims be regarded as including such equivalent constructions insofar as they do not depart from the spirit and scope of the present invention.

Other features and technical advantages of the present invention will become apparent from a study of the following description and the accompanying drawings.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein:

DETAILED DESCRIPTION OF THE PREFERRED EMBODIMENTS

Figure 1:
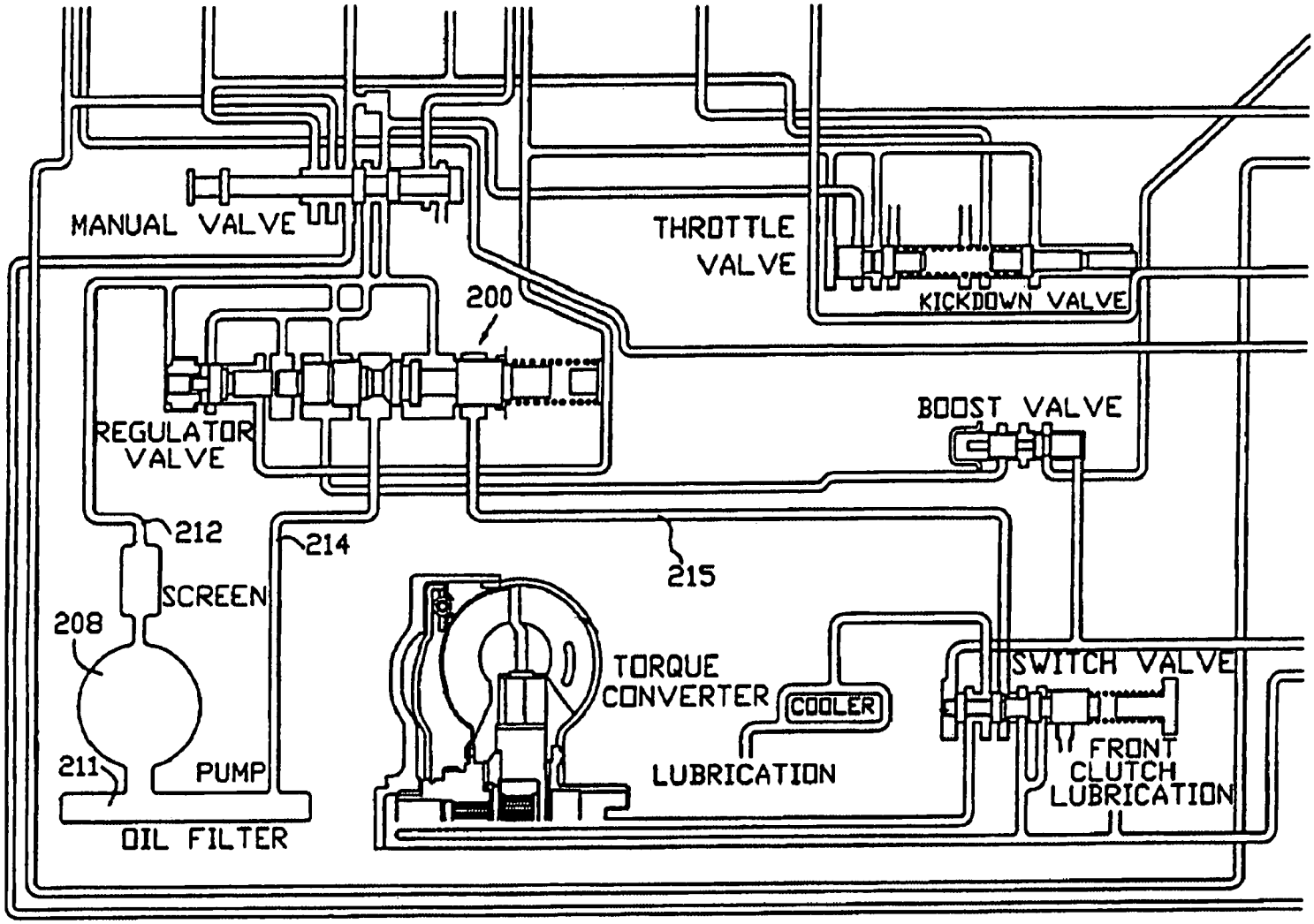
FIG.1 PRIOR ART
FIG. 1 is an enlarged view of a pertinent part of the hydraulic system of a CHRYSLER transmission and is labeled Prior Art.

Prior to describing the present invention in detail it may be beneficial to briefly review the function of the pressure regulator valve and the ATF pump within the hydraulic system of the CHRYSLER transmissions. Referring to FIG. 1 there is shown a partial schematic of the hydraulic system of the aforementioned Chrysler transmissions wherein a pressure regulator valve, indicated generally at 200, is illustrated. The pressure regulator valve 200 is located within the valve body 201 (FIG. 2) of the transmission and regulates line pressure in relation to vehicle operating conditions. In operation ATF at line pressure (i.e. 160-270 psi) from the hydraulic pump 208 enters the pressure regulator valve 200 via pump output circuit 212. The pressure regulator valve 200 routes ATF into both the converter charge circuit 215 and the sump return circuit 214 as shown in FIG. 1 depending on engine speed and operating conditions.

Figure 2:
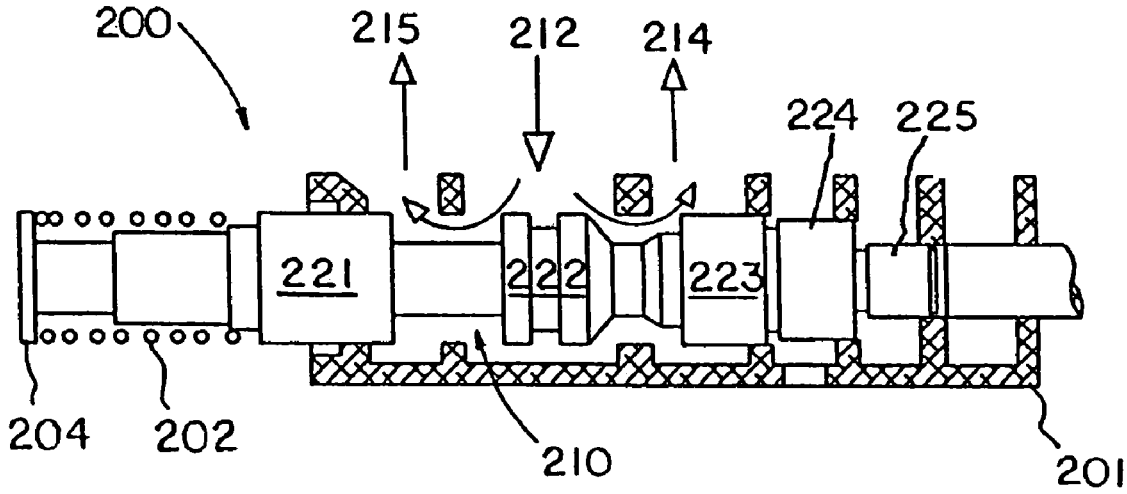
FIG. 2 PRIOR ART
FIG. 2 is a diagrammatic view of a pressure regulator valve for the CHRYSLER transmission and is labeled Prior Art.

As seen more clearly in FIG. 2, the pressure regulator valve 200 comprises a spool valve including a cylindrical piston, indicated generally at 210, having a plurality of concentric diameters or spools 221-225, a compression spring 202, and an end plug 204 arranged coaxially within the valve body 201 (shown in partial section view).

At engine idle the force of the spring 202 acting on the piston 210 keeps the pressure regulator valve 200 closed as shown in FIG. 1 and a substantial quantity of the ATF discharged by pump 208 flows back to the sump 211. This excess quantity is known as pressure regulator valve exhaust (i.e. regulator exhaust fluid). As engine speed increases ATF at line pressure moves the piston 210 against spring force as shown in FIG. 2 to open the converter charge circuit 215 to feed ATF to the torque converter. Under such operating conditions an increased volume of the pump output flowing to the pressure regulator valve 200 is released into the converter charge circuit 215 and a reduced volume is diverted to the sump 211 via the sump return circuit 214 (FIG. 1) depending on fluid pressure demands within the hydraulic system.

Figure 3:
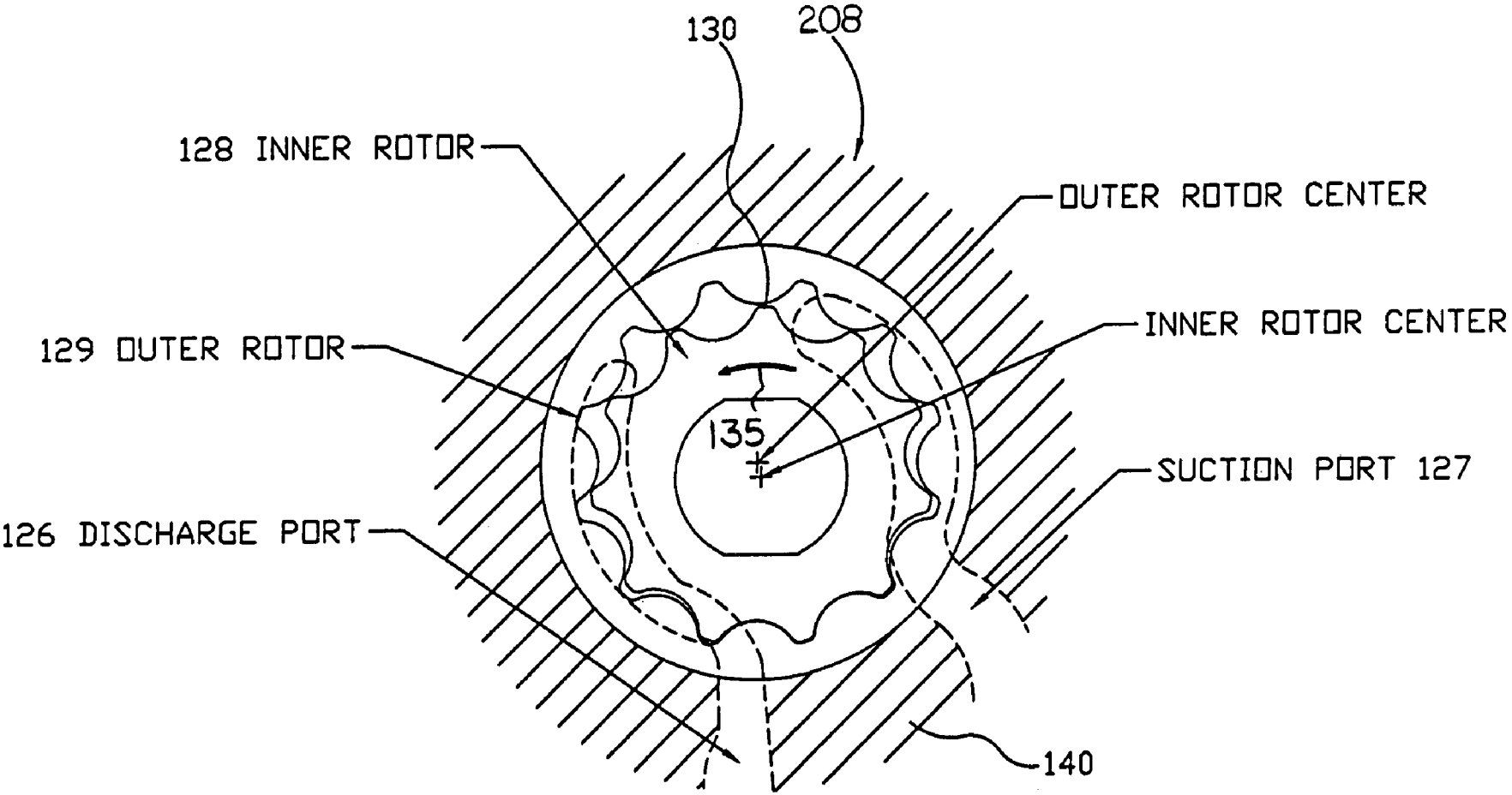
FIG. 3 PRIOR ART
FIG. 3 is a partially cutaway, plan view of a fixed displacement Gerotor type pump as installed within the pump body of a CHRYSLER transmission and is labeled Prior Art.

A positive displacement pump of the Gerotor type, indicated generally at 125 and illustrated in FIG. 3, is utilized in the CHRYSLER transmissions. However, other types of positive displacement pumps such as gear pumps and vane pumps may be utilized with the present invention. In the Gerotor type pump 125 as the inner rotor 128 turns each of its teeth maintains continuous line contact with a tooth of the outer rotor 129, the point of contact shifting from the flanks of the teeth 130 at full mesh to the tops of the teeth upon rotation as indicated by the directional arrow 135. In this way a pumping action is developed.

Suction port 127 and discharge port 126 are located in the pump body 140 to carry ATF into the suction side and away from the discharge side of the pump 208 respectively for delivery to the hydraulic system. Rotation of the pump 208 at engine speed generates vacuum within the suction port 127, which draws ATF from the sump 211.

Thus, the sump 211 must have sufficient ATF at all times to keep the pump 208 ready for operation (i.e. primed) in order to prevent air from being drawn into the pump. If the pump intake is exposed and air is permitted to enter the pump 208, line pressure may drop enough to cause engine stall on transmission engagement, slow torque converter charge at engine idle, and other transmission malfunctions.

Figure 4:
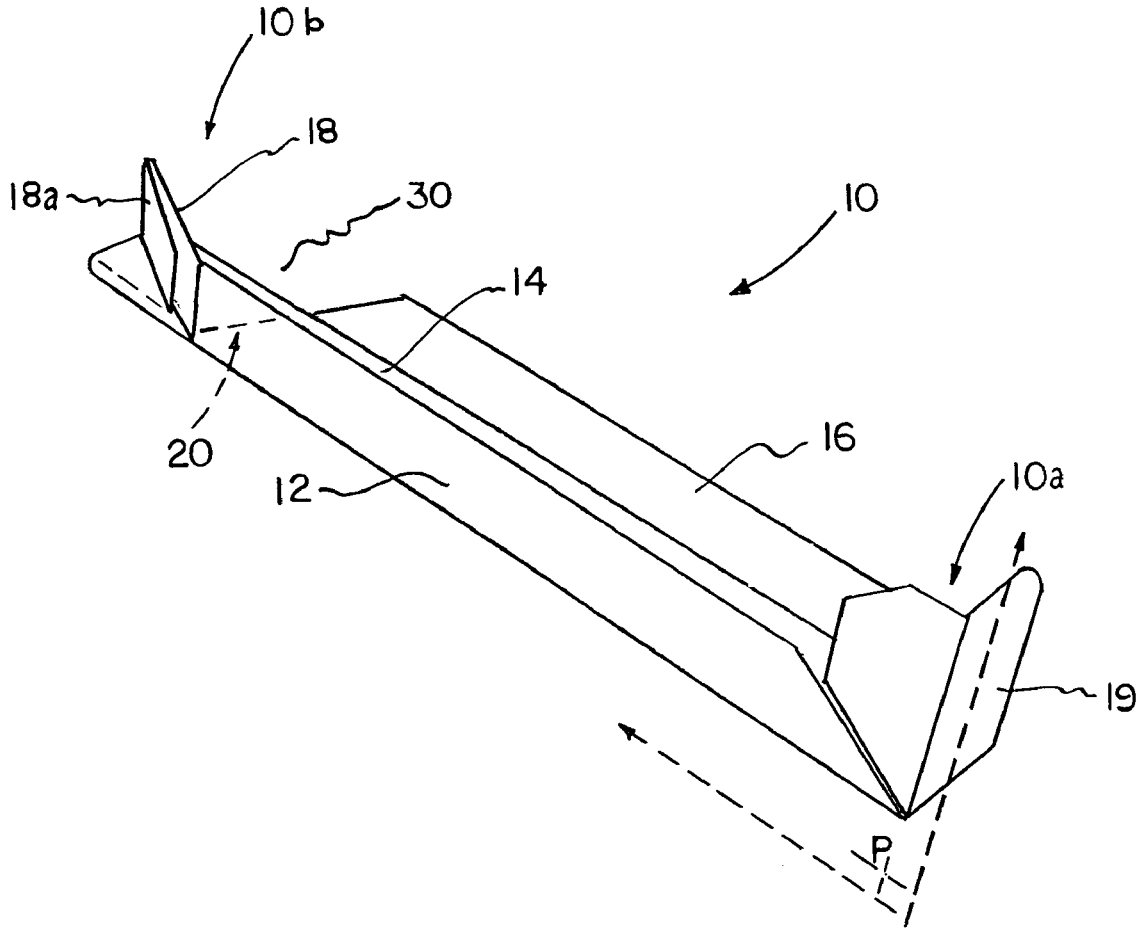
FIG. 4 is a perspective view of an embodiment of a pump priming device in accordance with the present invention.

Thus, the present invention has been devised to resolve the aforementioned service complaints in the CHRYSLER transmissions resulting from insufficient ATF flow to the pump 208 at low engine speeds. The present invention provides structures comprising pump-priming means including, but not limited to, the following structures. Referring to FIG. 4 there is shown an embodiment of a pump-priming device in accordance with the present invention, indicated generally at 10. In this embodiment it can be seen that the pump priming device 10 is a channel structure configured to drop-in-place within the valve body 201 during assembly without the need for fasteners or adhesives as hereinafter explained in further detail.

The pump priming device 10 effectively provides a pump-priming circuit, which functions to divert regulator exhaust fluid flowing through the OEM sump return circuit 214 and route it directly back to the pump suction port 127 to keep the pump 208 primed at low operating speeds.

Figure 5:
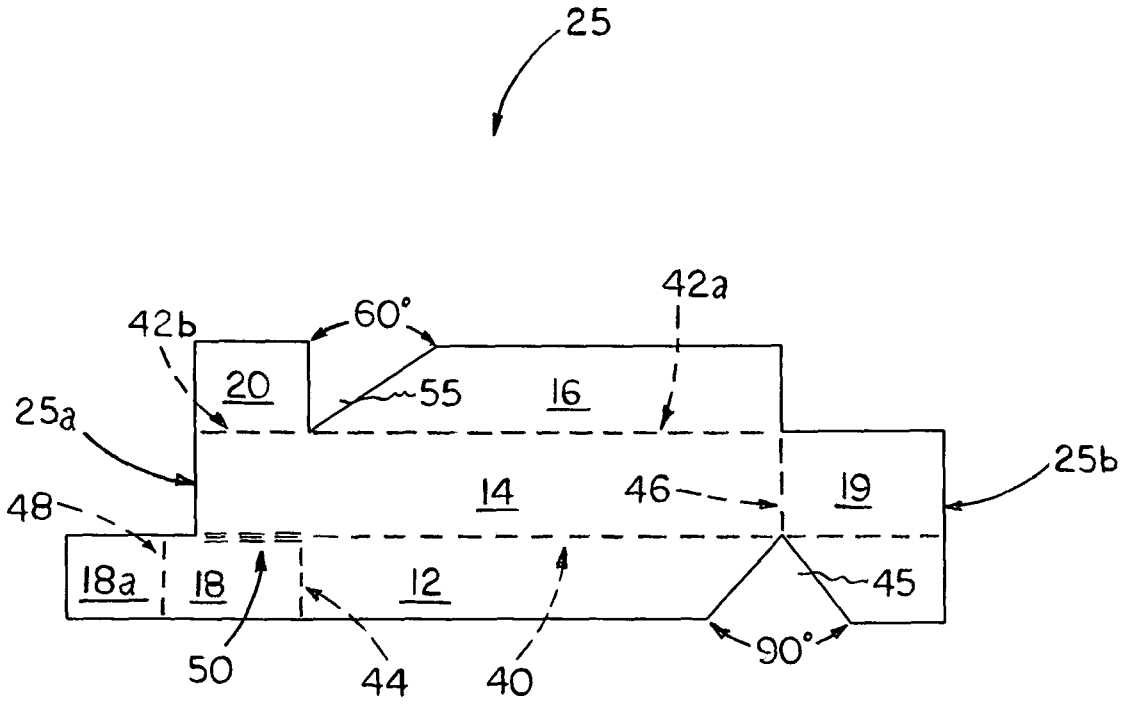
FIG. 5 is a plan view of an embodiment of a blank member utilized to form the pump priming device of the present invention.

Referring to FIG. 5 the details of the construction of the pump priming device 10 will now be described. In the embodiment shown the pump priming device 10 is fabricated from a single blank member (hereinafter "blank"), indicated generally at 25, of a bendable material such as sheet metal or other suitable material. Blank 25 includes at one edge thereof a bottom wall section 12 connected to an adjacent longitudinal edge of a sidewall section 14 along a fold line 40, where the blank 25 is folded 90° and connects the bottom wall section 12 to the sidewall section 14. Fold line 40 is coincident with a cut line 50 extending inwardly from a first lateral end 25*a* of blank 25 and terminating at fold line 44 and delineating a ramp section 18. Bottom wall section 12 also includes a triangular cutout section 45 in proximity to a second lateral end 25*b* of blank 25. Cutout section 45 defines a 90° included angle and extends across the width of the bottom wall section 12. The apex of the 90° included angle which defines cutout section 45 is coincident with a fold line 46, which extends across the width of sidewall section 14, where blank 25 is folded 90° and connects sidewall section 14 to an end wall section 19 forming an inlet end 10*a* (FIG. 4) of the pump priming device 10.

The opposing longitudinal edge portion of sidewall section 14 is integrally connected to an adjacent longitudinal edge of a top wall section 16 along fold line 42*a*, where blank 25 is folded 90° and connects the sidewall section 14 to the top wall section 16 such that bottom and top wall sections 12, 16 are disposed in generally parallel relation and symmetrically disposed about a center plane -P- as seen in FIG. 4.

Top wall section 16 also includes a triangular cutout section 55 in proximity to the first lateral end 25*a* of blank 25, which defines a 60° included angle and extends across the width of the top wall section 16. The apex of the 60° included angle, which defines cutout section 55, is coincident with a fold line 42*b*, which extends to the first lateral end 25*a*, where blank 25 is folded 180° onto itself to provide a reinforcing tab 20, which delineates, in part, an opening 30 at the outlet end 10*b* (FIG. 4) of the pump priming device 10.

To complete the construction of pump priming device 10, the ramp section 18 is integrally connected to an adjacent lateral end of bottom wall section 12, where blank 25 is folded 30° inwardly toward the top wall section 16. Ramp section 18 is also folded along fold line 48, where the ramp section is folded 180° outwardly onto itself forming a flap section 18*a* further delineating opening 30 formed in the outlet end 10*b* of the priming device 10. When so constructed, it will be appreciated that opening 30 which extends through outlet end 10*b* is oriented at a 90 degree rotated angle in relation to plane -P- as more clearly shown in FIG. 6A.

Figure 7:
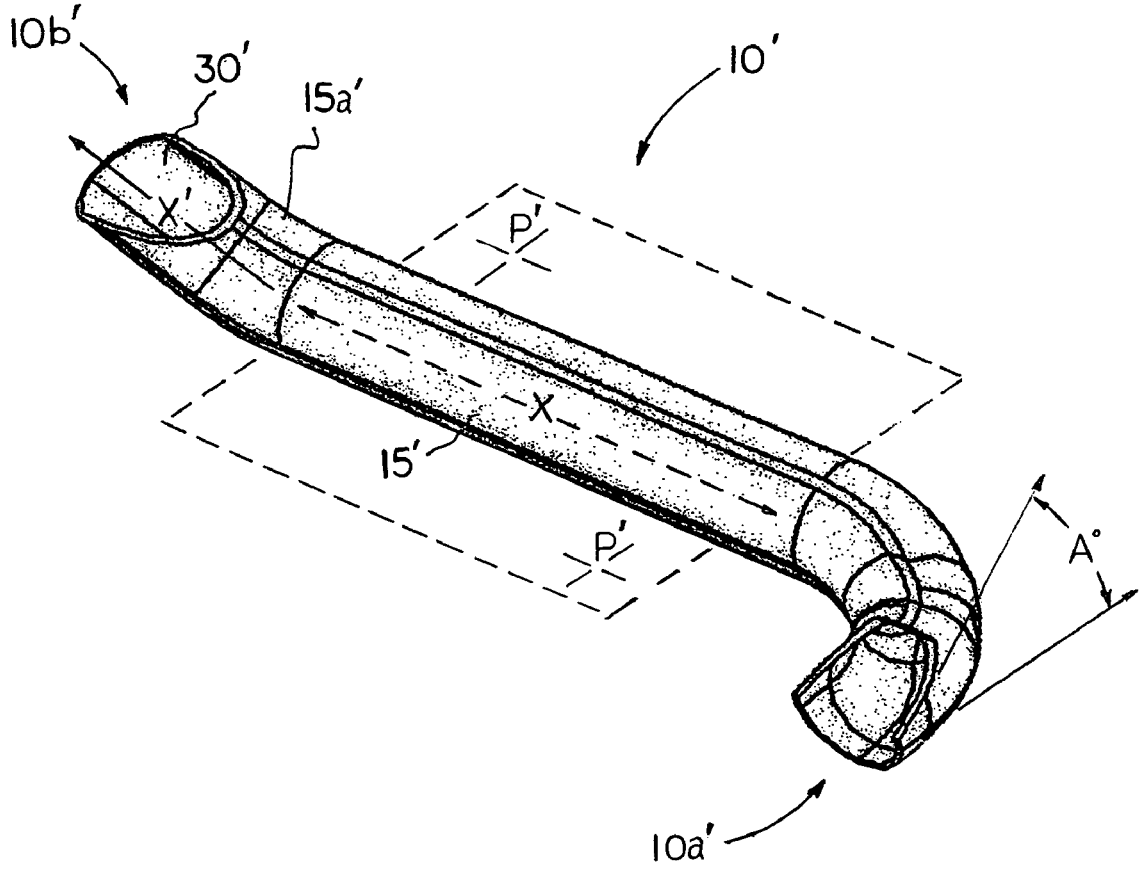
FIG. 7 is a perspective view of an alternative embodiment of the present pump priming device.

In an alternative embodiment the pump-priming device is a tubular construction, indicated generally at 10' and illustrated in FIG. 7. In this embodiment the pump priming device 10' is fabricated from a bendable tubing material such as steel, aluminum, copper, heat resistant plastic or other material suitable for this purpose. The functional aspects of the pump priming device 10' are the same as those described hereinabove for the pump priming device 10. Pump priming device 10' is also configured for installation within the valve body 201 (FIG. 8).

The pump priming device 10' includes a tubular body member 15' having an inlet end 10*a'* and an outlet end 10*b'* as shown in FIG. 7. It can be seen that the openings defined by inlet end 10*a'* and outlet end 10*b'* are formed at an oblique angle -A- to a transverse plane -P'-, which extends through a longitudinal axis -X- of body member 15'. In a preferred embodiment angle -A- measures in the range of 20 to 40 degrees. When so constructed, both inlet end 10*a*' and outlet end 10*b*' define openings having a maximum cross-sectional area to increase the flow of ATF through the pump priming device 10'. As in the previous embodiment, it will be appreciated that opening 30' which defines outlet end 10*b*' is oriented at a 90 degree rotated angle about axis -X- relative to the plane -P'- as shown in FIG. 7. Further, it can be seen that a terminal segment 15*a*' of pump priming device 10' is offset at an oblique angle to axis -X- of body member 15' to position outlet end 10*b*' for delivery of fluid to the pump inlet. In a preferred embodiment axis -X'- of terminal segment 15*a*' is offset in the range of 5 to 15 degrees to axis -X- of body member 15'.

Figure 6A:
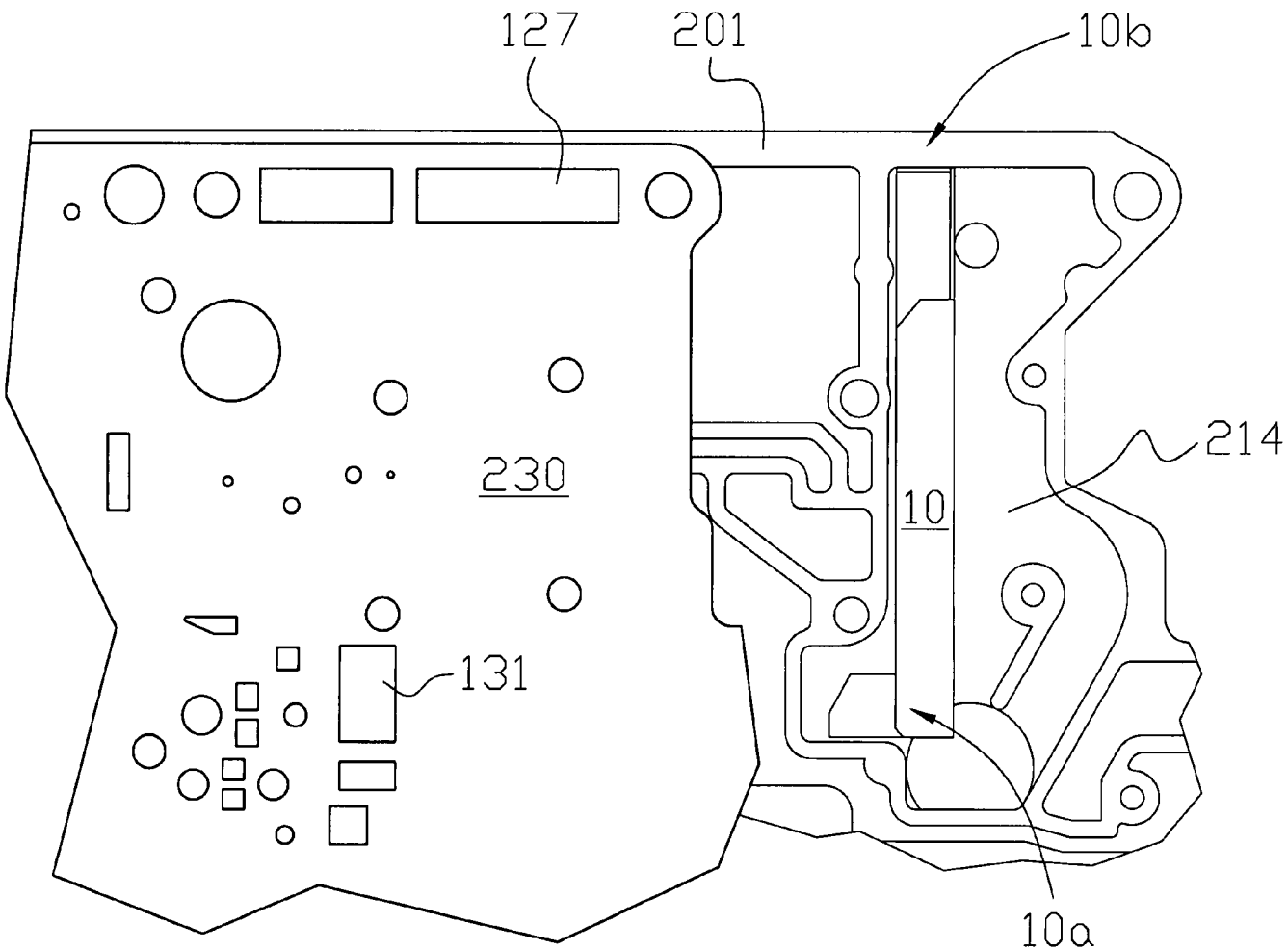
FIG. 6A is a plan view of a half-section of the valve body of a CHRYSLER transmission showing the pump priming device installed in its functional position.
Figure 6B:
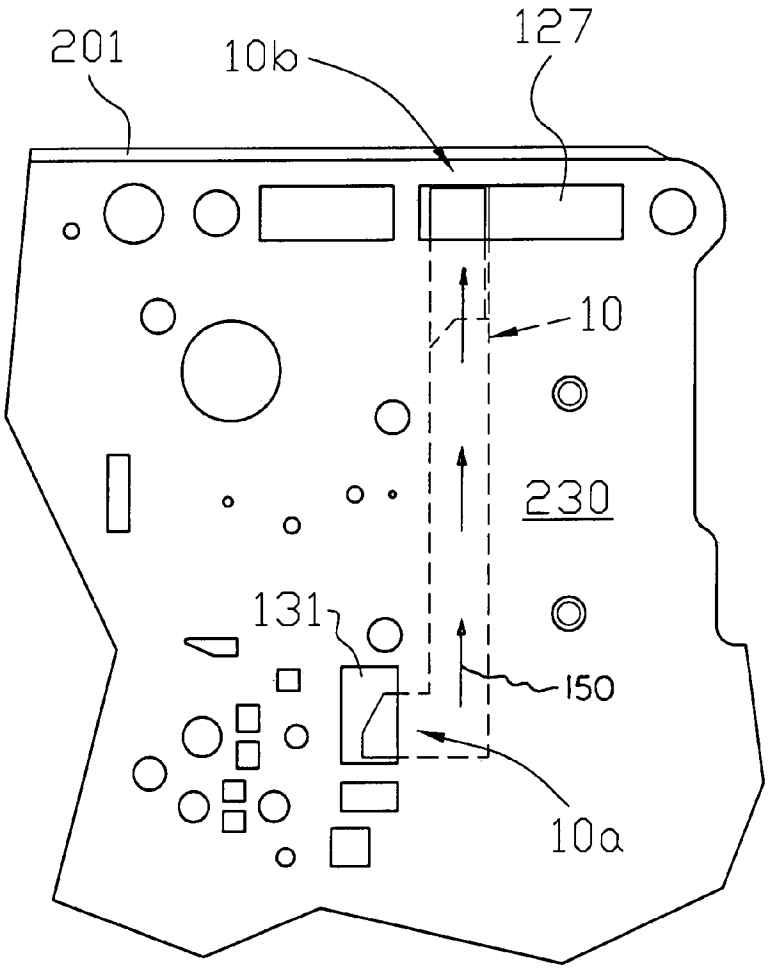
FIG. 6B is a plan view of the valve body of FIG. 6A showing a separator plate installed thereon to retain the pump priming device in its functional position.
Figure 8:
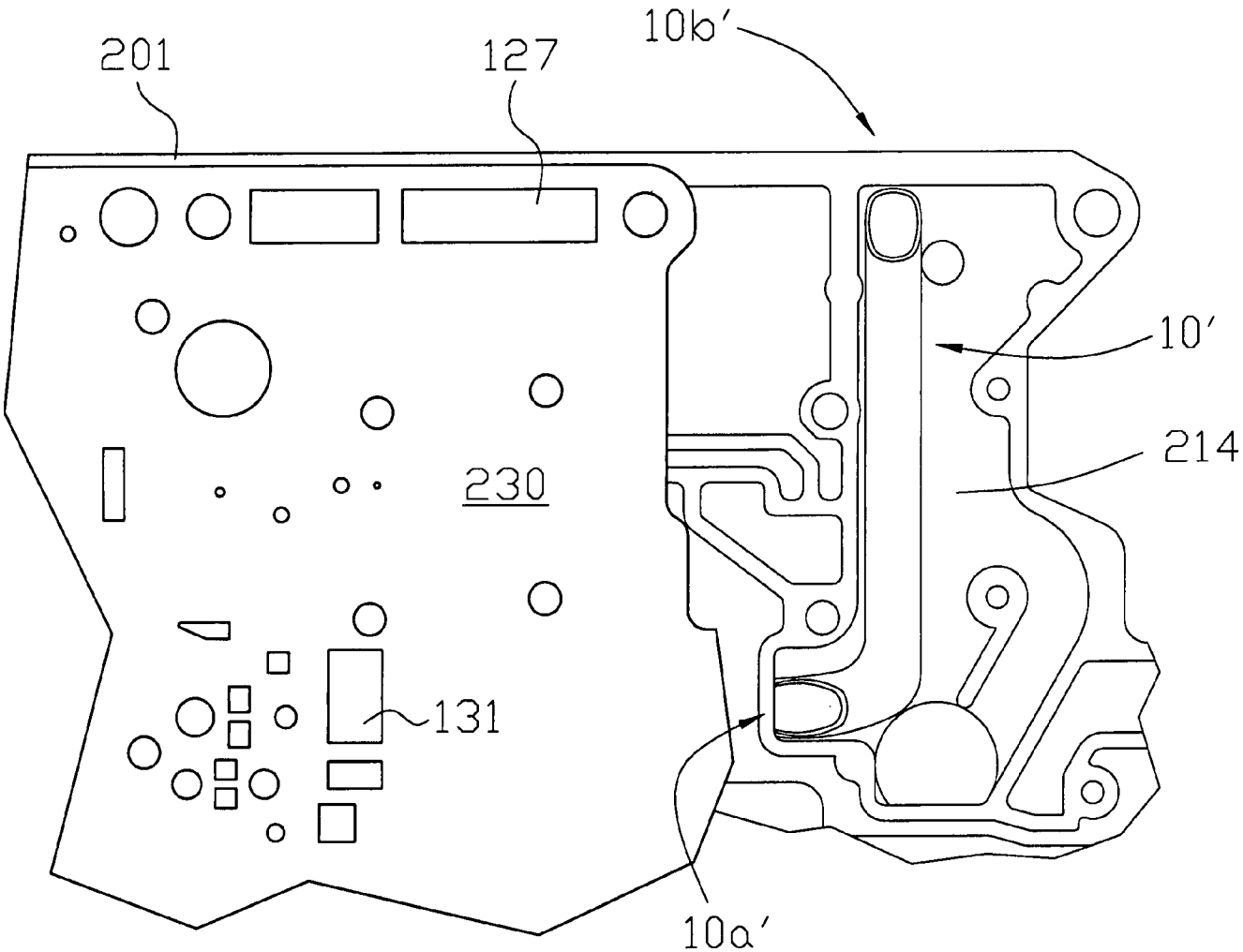
FIG. 8 is a partially cutaway plan view of a half-section of a valve body of a CHRYSLER transmission showing the alternative embodiment of the pump priming device shown in FIG. 7 installed in its functional position.

In practical use the pump priming device 10, 10' is installed in the valve body half-section 201 as shown in FIGS. 6A-6B and FIG. 8 at a location wherein the sump return circuit 214 is accessible. In this position the pump priming device 10, 10' is disposed in fluid communication with the pump suction port 127 and also with the regulator exhaust port 131. More particularly, the pump priming device 10, 10' is positioned such that the inlet end 10*a*, 10*a*' thereof receives ATF flowing from the pressure regulator valve 200 (i.e. regulator exhaust fluid) en route to the sump via the regulator exhaust port 131 and diverts it (as shown by directional arrows 150 in FIG. 6B) directly back to the pump suction port 127 via outlet end 10*b*, 10*b*' to keep the pump 208 primed at all operating speeds. It will be noted that the pump 208 continues to draw ATF from the sump 211 via suction port 127 as in normal operation.

The pump priming device 10, 10' is retained in position in the valve body 201 upon installation of a separator plate 230 (FIGS. 6A-6B) in the standard assembly procedure for the CHRYSLER transmission.

The pump priming device 10, 10' of the present invention has been demonstrated to resolve the aforementioned service complaints based on road testing of various vehicles utilizing the CHRYSLER transmissions, which have been modified by installation of the pump priming devices disclosed herein.

Although not specifically illustrated in the drawings, it should be understood that additional equipment and structural components will be provided as necessary and that all of the components described above are arranged and supported in an appropriate fashion to form a complete and operative Automatic Transmission Pump Priming Device incorporating features of the present invention.

Moreover, although illustrative embodiments of the invention have been described, a latitude of modification, change, and substitution is intended in the foregoing disclosure, and in certain instances some features of the invention will be employed without a corresponding use of other features. Accordingly, it is appropriate that the appended claims be construed broadly and in a manner consistent with the scope of invention.

What is claimed is:

1. An improved valve body for an automatic transmission system, wherein said valve body comprises mating half-sections having a plurality of fluid circuits formed therein, said transmission system including a fluid pump disposed in fluid communication with a pump inlet circuit and a pump output circuit extending through said valve body, said valve body including a pressure regulator valve disposed in fluid communication with said pump output circuit and a sump return circuit, wherein transmission fluid is carried within said pump output circuit to said pressure regulator valve, said pressure regulator valve diverting a quantity of said fluid to said sump return circuit at a predetermined fluid pressure, wherein the improvement comprises:

pump-priming means disposed in said valve body in fluid communication with said sump return circuit and said pump inlet circuit such that a predetermined volume of fluid flowing within said sump return circuit is diverted to said pump inlet to prime said pump at low engine speeds.

2. The improved valve body of claim 1 wherein said pump-priming means comprises a channel structure including a bottom wall, a pair of perpendicular sidewalls, an inlet, and an outlet for conveying transmission fluid.

3. The improved valve body of claim 2 wherein said inlet is formed in perpendicular relation to said channel structure.

4. The improved valve body of claim 3 wherein said outlet is formed at a 90 degree rotated angle to said inlet.

5. The improved valve body of claim 1 wherein said pump-priming means comprises a tubular structure having a longitudinal axis, a first end, and a second end.

6. The improved valve body of claim 5 wherein said first end is disposed at a 90 degree angle to said longitudinal axis to form an inlet, wherein said second end is disposed at an acute angular offset to said longitudinal axis to form an outlet.

7. The improved valve body of claim 6 wherein said tubular structure is undercut at the juncture of said first end and said second end at an acute angle to said longitudinal axis.

* * * * *